United States Patent [19]

Hanegraaf

[11] Patent Number: 4,919,016

[45] Date of Patent: Apr. 24, 1990

[54] TAB TOP BEVERAGE CONTAINER OPENER

[76] Inventor: John C. Hanegraaf, Rt. 4 Otte Ct., Appleton, Wis. 54915

[21] Appl. No.: 311,072

[22] Filed: Feb. 14, 1989

[51] Int. Cl.[5] ..... B67B 7/00

[52] U.S. Cl. ..... 81/3.55; 81/3.41

[58] Field of Search ..... 81/3.09, 3.41, 3.55

[56] References Cited

U.S. PATENT DOCUMENTS

| | | | |
|---|---|---|---|
| 888,580 | 5/1908 | Brinn | 81/3.41 |
| 3,495,284 | 2/1970 | Weingardt | 81/3.55 X |
| 4,253,352 | 3/1981 | O'Neal | 81/3.55 |
| 4,416,171 | 11/1983 | Chmela et al. | 81/3.55 |
| 4,466,313 | 8/1984 | Gardner | 81/3.55 |
| 4,530,260 | 7/1985 | Holka | 81/3.55 |
| 4,607,407 | 8/1986 | Bergmeister | 81/3.09 X |
| 4,765,208 | 8/1988 | Sakosky | 81/3.55 |
| 4,825,728 | 5/1989 | Mitchell | 81/3.09 |

*Primary Examiner*—James G. Smith

*Attorney, Agent, or Firm*—Andrus, Sceales, Starke & Sawall

[57] ABSTRACT

An opener tool for a tab top beverage container or the like is adapted for engagement with the fingertip of a user. The opener tool includes a finger-engaging portion and a portion adapted to bear against the front of the fingertip. A tab engaging structure is formed on the latter portion for engaging the tab top of the beverage container. The tab engaging portion includes a tab receiving passage which extends along an axis substantially parallel to and spaced inwardly from the longitudinal axis of the portion of the user's finger engaging the opener tool. The structure so formed provides an efficient and easy to operate tab top opening mechanism.

11 Claims, 2 Drawing Sheets

FIG. 1
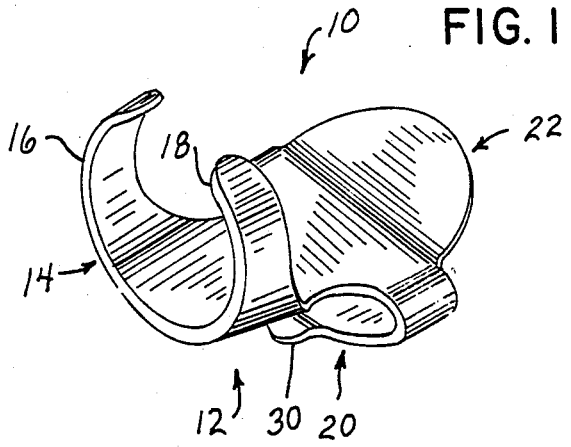
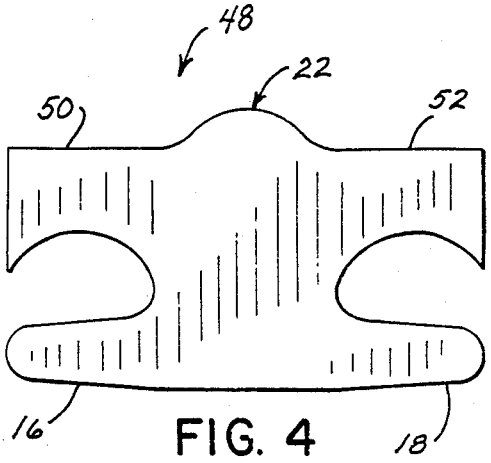
FIG. 4
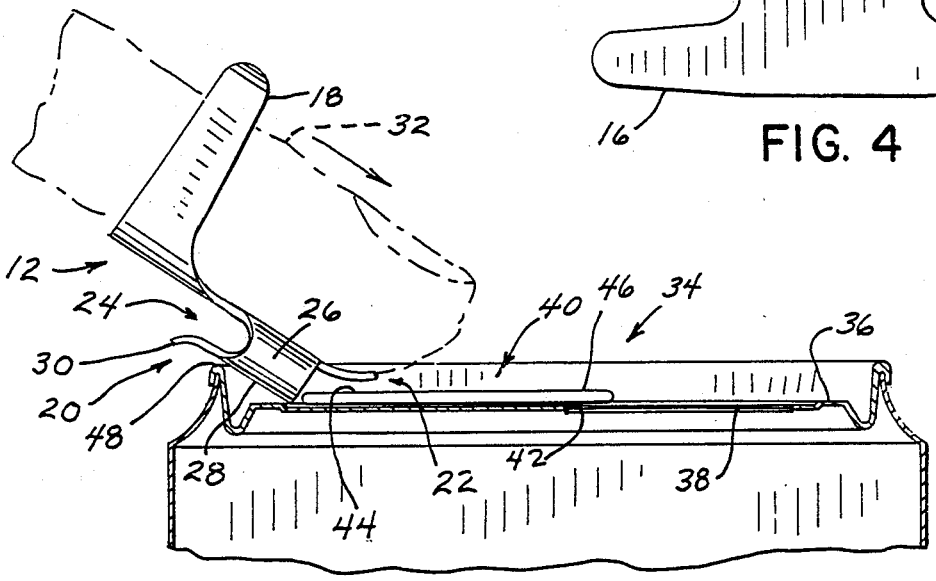
FIG. 2
FIG. 3
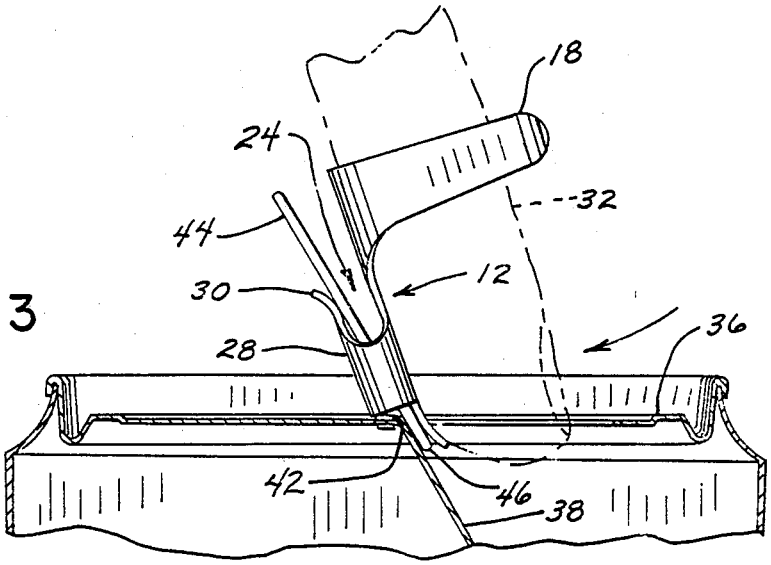

TAB TOP BEVERAGE CONTAINER OPENER

BACKGROUND AND SUMMARY

This invention relates to a device for opening a beverage container, and more particularly to such a device which is adapted for engagement with a finger of the user.

Various devices are known for aiding in opening of a beverage can. Patents relating to such devices are U.S. Pat. No. 4,253,352 to O'Neal; U.S. Pat. No. 4,416,171 to Chmela et al; U.S. Pat. No. 4,466,313 to Gardner; and U.S. Pat. No. 4,530,260 to Holka.

Gardner U.S. Pat. No. 4,466,313 is of interest, in that it provides a thimble-like structure with a flattened tab top opener projecting therefrom. That portion of the opener adapted for engagement with the tab top projects forwardly of the end of the fingertip, and creates stress in the fingertip when operated.

In accordance with the present invention, a beverage container opener tool for engagement with the finger of a user is disclosed. The opener tool includes a body portion with finger-engaging means. In one embodiment, a pair of upstanding curved prongs project from the body portion for engaging the sides of a user's finger. The body portion is adapted to bear against the front of the finger at or near the fingertip. Tab engaging means is provided for engaging the tab top, and is rigidly connected to the body portion. The tab engaging means projects outwardly from the body portion, and is disposed at or below the end of the finger. The tab engaging means includes a tab receiving passage extending along an axis substantially parallel to, and spaced inwardly from, the longitudinal axis of the portion of the finger engaged with the finger engaging means.

In a preferred embodiment, the opener tool of the invention is formed from a stamped, flat piece of metal. The finger-engaging prongs are bent upwardly from the body portion in one direction, and projections for forming the tab-receiving passage are bent downwardly in the other direction so that their ends are brought into close proximity with one another. In this manner, the tab-receiving passage is defined. Forming the opener tool of metal provides durability and ease of use. Alternatively, the opener tool of the invention could be injection molded from a plastic material.

BRIEF DESCRIPTION OF THE DRAWINGS

The drawings illustrate the best mode presently contemplated of carrying out the invention.

In the drawings:

FIG. 1 is an isometric view of an opener tool constructed according to the invention;

FIG. 2 is a side elevation view, partially in section, showing the opener tool of the invention in operation, prior to engagement of the tool with a tab top;

FIG. 3 is a view similar to FIG. 2, showing full engagement of the opener tool of the invention with the tab top and the tab top pivoted so as to open the beverage container;

FIG. 4 is a plan view of a blank from which the opener tool of FIG. 1 is formed;

DETAILED DESCRIPTION OF THE PREFERRED EMBODIMENT

Figure 5:
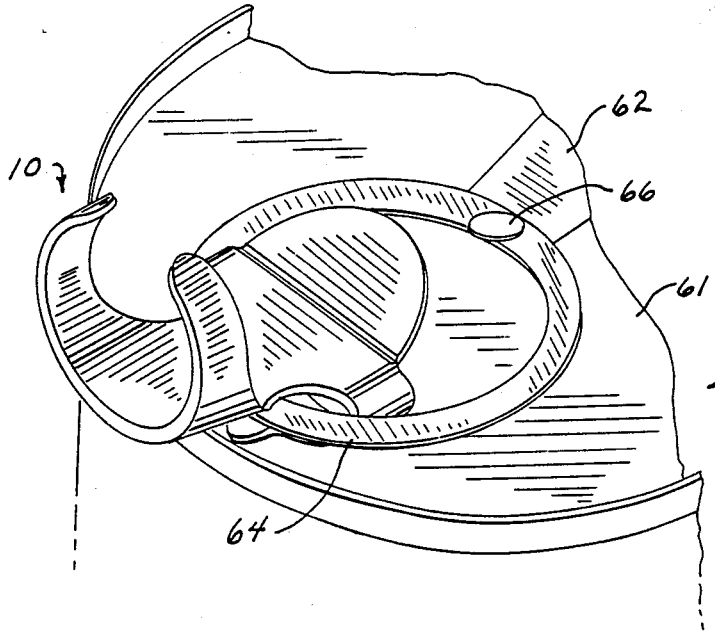
FIG. 5 is a partial isometric view showing the opener tool of the invention as used for opening a container having a ring-type opening system.

With reference to FIG. 1, an opener tool 10 includes a body portion 12, at one end of which a ring-like portion 14 is formed. Ring-like portion 14 is formed from a pair of upstanding, spaced prongs 16, 18, which are curved so as to conform to the typical curvature of a finger. Curved prongs 16, 18 define a finger-receiving passage therebetween, the size of which can be varied according to user requirements.

At the other end of body portion 12, a tab-engaging portion 20 is provided. A rounded end portion 22 extends from body portion 12 beyond tab-engaging portion 20.

With reference to FIG. 2, it is seen that tab-engaging portion 20 includes a tab-receiving passage 24, defined by a pair of spaced side walls, one of which is shown at 26, and an outer wall 28. Outer wall 28 extends rearwardly beyond the side walls, terminating in a curved, rounded end portion 30.

As shown in FIG. 2, opener tool 10 is adapted to receive a finger of a user, the finger being shown in phantom at 32. As noted, the sides of finger 32 are adapted to be engaged by upstanding curved prongs 16, 18, with body portion 12 being adapted for placement against the forward side of finger 32. Opener tool 10 is adapted for placement substantially at the tip of finger 32. End portion 22 of body 12 is curved so as to accommodate the inward curve at the tip of finger 32, as shown.

The angle between body portion 12, which is substantially flat, and a plane through prongs 16, 18 is preferably less than 90°. With this construction, body portion 12 is forced against the frontward side of finger 32 when finger 32 is engaged by prongs 16, 18.

Opener tool 10 is intended for use with a beverage can, shown generally at 34, having a top 36 including a scored closure 38. A tab structure, shown at 40, is mounted to top 36 by means of a rivet or the like, shown at 42. Tab structure 40 includes a lever end 44 and an opener end 46. As is known, lever end 44 of tab 40 is adapted for pivoting upward movement, resulting in pivoting downward movement of opener end 46 into engagement with scored closure 38. Continued such movement forces scored closure 38 downwardly so as to open can 34.

With opener tool 10 in place on finger 32 as shown, lever end 44 of tab 40 is received within tab receiving passage 24 by means of a push-on movement substantially in line with the longitudinal axis of tab 40. Such forward movement continues until abutment of the forward end of outer wall 28 with rivet 42.

After insertion of tab 40 within tab receiving passage 24 as described above, the user then moves his or her finger 32 upwardly in a rotational type movement, resulting in a like movement of opener tool 10, as shown in FIG. 3. Such movement of opener tool 10 results in engagement of the lower surface of tab lever end 44 with the inner surface of outer wall 28, and engagement of tab opener end 46 with the outer surface of body end portion 22. Continued rotational movement of opener tool 10 as described results in pivoting of tab 40 as shown in FIG. 3, causing downward movement of scored closure 38 to open can 34, as is known. Opener tool 10 is then removed from tab 40 by withdrawing tab 40 from tab receiving passage 24.

The curve of end portion 30 of outer wall 28 is adapted to ride on the rim 48 of can 34 during insertion of tab 40 into tab receiving passage 24. This action provides an upward lifting motion to tab 40 to accommodate its entry into tab receiving passage 24.

FIG. 4 illustrates a blank 48 from which opener tool 10 is formed. Blank 48 includes prongs 16, 18 which are bent in a curved manner so as to form a finger receiving passage as described above. A pair of projections 50, 52 are spaced from prongs 16, 18. Projections 50, 52 are adapted to be bent in a direction opposite to that of prongs 16, 18 so as to form tab receiving passage 24. The ends of projections 50, 52 are in close proximity to each other after such bending so as to substantially close tab receiving passage 24. Rounded end portion 22 is then curved uwardly to accommodate the curve of a fingertip, as described.

With reference to FIG. 5, a container 60 containing a beverage, medication or the like is provided with a top 61 having a scored closure 62. A ring 64 is connected to scored closure 62 by means of a rivet 66. As is known, ring 64 is adapted for engagement by a finger for upward lifting movement, so as to open container 60 by removing closure 62 completely from the top of container 60.

Figure 6:
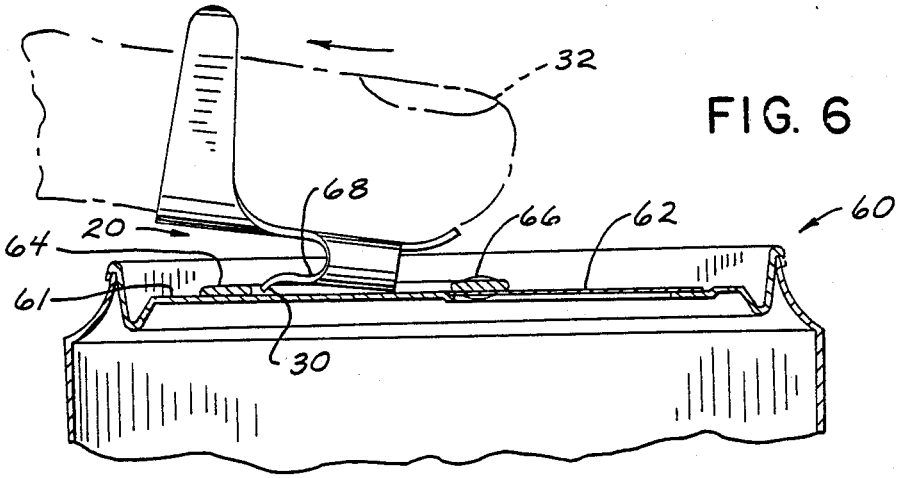
FIG. 6 is a view similar to FIGS. 2 and 3, showing engagement of the ring of a ring-type opening system with the opener tool of the invention.
Figure 7:
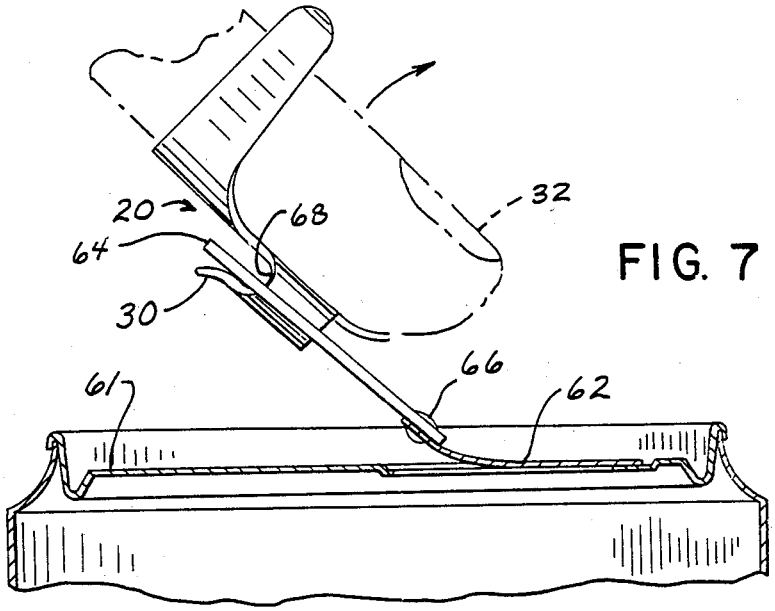
FIG. 7 is a view similar to FIG. 6, showing opening of a ring-type opening system.

Opener tool 10 eases opening of container 60 by making it easier to engage ring 64 than by fingertip engagement. As shown in FIG. 6, opener tool 10 is first placed on finger 32 as described previously, and tab-engaging portion 20 is placed within ring 64 and onto container top 61. Opener tool 10 is then slid along container top 61 rearwardly until engagement of the rear portion of ring 64 by end portion 30. Due to the shape of end portion 30, continued such movement results in upward lifting of the rearward portion of ring 64, which rides along the inwardly facing surface of end portion 30 until engagement with the rear surface of the side walls forming passage 24, one of which is shown at 68. Thereafter, the user lifts his or her finger upwardly, as shown in FIG. 7, which results in removal of closure 62 from container top 61, in a manner as is known.

Various alternatives and modifications are contemplated as being within the scope of the following claims particularly pointing out and distinctly claiming the subject matter regarded as the invention.

I claim:

1. An opener tool for use in opening cans of the type having a lid with a scored closure for inward displacement by a pivotable tab, said tab including a lever end and an opener end, with the lever end of the tab being adapted for pivoting upwardly in an arcuate path to move the opener end of the tab downwardly into displacing engagement with the closure, said opener tool comprising:

a ring-like member including means defining a passage for receiving at least a portion of a finger therein, said ring-like member including a portion adapted to bear against the front of said finger extending forwardly of said means defining a passage for receiving at least a portion of a finger therein; and tab engaging means for engaging said tab, said tab engaging means being associated with said forwardly extending portion of said ring-like member and being rigidly interconnected with the portion of said ring-like member adapted to bear against the front of said finger and projecting outwardly therefrom, said tab engaging means including a tab receiving passage extending along an axis sustantially parallel to, and spaced from, the longitudinal axis of the portion of said finger received within said ring-like member.

2. The opener tool of claim 1, wherein said tab receiving passage is formed by a pair of projections extending outwardly from said forwardly projecting portion, said projections being bent toward each other to form said passage.

3. The opener tool of claim 1, wherein said forwardly projecting portion projects beyond said tab receiving passage for engaging the opener end of said tab.

4. The opener tool of claim 1, wherein said passage is defined in part by a wall spaced from the portion of said ring-like member adapted to bear against the front of said finger, said wall terminating at its rearward end in a curved end portion adapted to engage the ring of a ring-type opening assembly for aiding in opening a container provided with such an assembly.

5. An opener tool for use in opening cans of the type having a lid with a scored closure for inward displacement by a pivotable tab, said tab including a lever end and an opener end, with the lever end of the tab being adapted for pivoting upwardly in an arcuate path to move the opener end of the tab downwardly into displacing engagement with the closure, said opener tool comprising:

an axially extending body portion;

finger engaging means associated with said body portion for receiving a finger therein and allowing said body portion to be positioned at the end of said finger; and tab engaging means for engaging said tab, said tab engaging means being rigidly connected to said body portion and projecting outwardly therefrom, said tab engaging means including a tab receiving passage extending along an axis substantially parallel to, and spaced from, the longitudinal axis of the portion of said finger received within said finger engaging means, said tab receiving passage being formed by a pair of side walls extending outwardly from said body portion, and an outer wall extending between said side walls, wherein said outer wall of said tab receiving passage is provided at its rearward end with a curved end portion adapted to engage the ring of a ring-type opening assembly for aiding in opening a container provided with such an assembly.

6. An opener tool for use in opening cans of the type having a lid with a scored closure for inward displacement by a pivotable tab, said tab including a lever end and an opener end, with the lever end of the tab being adapted for pivoting upwardly in an arcuate path to move the opener end of the tab downwardly into displacing engagement with the closure, said opener tool comprising:

a body portion having first and second surfaces;

means defining a finger-receiving passage projecting outwardly from said body portion so as to receive a finger therein, with the front of said finger being engaged with said first surface of said planar body portion; and means defining a tab-receiving passage projecting outwardly from said body portion so as to receive said tab therein, with said tab being engaged by said second surface of said planar body portion and by a wall of said tab-receiving passage;

wherein said tab is engaged within said tab-receiving passage by a push-on motion of said opener tool, and wherein a rotational movement of said opener tool after engagement of said tab causes upward pivoting movement of the lever end of said tab and downward movement of the opener end of said tab to open said scored closure.

7. The opener tool of claim 6, wherein said means defining a finger-receiving passage comprises a pair of spaced, upstanding curved prongs provided at one end of said planar body portion and adapted to engage the sides of said finger when received therein.

8. The opener tool of claim 7, wherein said pair of spaced, upstanding curved prongs are formed integrally with said planar body portion.

9. The opener tool of claim 6, wherein said means defining a tab-receiving passage comprises a pair of spaced side walls projecting outwardly from said body portion, and an outer wall extending between said spaced side walls.

10. The opener tool of claim 9, wherein one of said side walls and a portion of said outer wall is formed by a projection formed integrally with one side of said body portion and bent such that its distal portion is disposed substantially parallel to said other wall of said body portion, and wherein the other of said side walls and the remainder of said outer wall are formed from a similar projection formed integrally with the other side of said body portion.

11. The opener tool of claim 9, wherein the outer wall defining said tab-receiving passage is provided at its rearward end with a curved end portion adapted to engage the ring of a ring-type opening assembly for aiding in opening a container provided with such an assembly.

* * * * *